United States Patent [19]

Chabert et al.

[11] Patent Number: 4,660,771

[45] Date of Patent: Apr. 28, 1987

[54] ELECTROSTATIC PAINTING APPARATUS

[75] Inventors: Pierre Chabert, Grenoble; Roger Tholome, La Tronche, both of France

[73] Assignee: Sames S.A., Meylan, France

[21] Appl. No.: 652,463

[22] Filed: Sep. 20, 1984

[30] Foreign Application Priority Data

Sep. 27, 1983 [FR] France ..... 83 15328

[51] Int. Cl.[4] ..... B05B 5/02

[52] U.S. Cl. ..... 239/694; 239/69; 239/707; 239/708; 239/752

[58] Field of Search ..... 239/69, 694, 696, 705–707, 239/708, 112, 113, 186, 187, 290, 296, 297, 300, 412, 415, 416.2, 414, 750–752

[56] References Cited

U.S. PATENT DOCUMENTS

| | | | |
|---|---|---|---|
| 3,301,488 | 1/1967 | Norris | 239/186 |
| 3,393,658 | 7/1968 | Ott | 239/186 |
| 3,450,092 | 6/1969 | Kock | 239/112 |
| 3,667,682 | 6/1972 | Purnell | 239/412 |
| 4,201,150 | 5/1980 | Edwards | 239/186 |
| 4,228,958 | 10/1980 | Perry | 239/412 |

FOREIGN PATENT DOCUMENTS

| | | | |
|---|---|---|---|
| 1476964 | 4/1967 | France . | |
| 1537997 | 8/1968 | France . | |
| 2448392 | 9/1980 | France . | |
| 2515988 | 5/1983 | France . | |
| 2520132 | 7/1983 | France | 239/112 |

*Primary Examiner*—Andres Kashnikow
*Assistant Examiner*—Michael J. Forman
*Attorney, Agent, or Firm*—Sandler and Greenblum

[57] ABSTRACT

Electrostatic painting apparatus comprises a support moveable at high speed along a slide. On this support is a pneumatically controlled paint sprayer producing an electrostatically charged jet of paint. A paint feed assembly comprising a pressure regulator and a discharge valve is juxatposed with the sprayer. Sprayer control devices are disposed on a chassis connected to the feed assembly by a harness. These control means comprise three gas pressure regulators supplying the sprayer and controlling the paint pressure regulator and a high DC voltage generator. The position of the chassis relative to the slide is determined such that the harness is as short as possible, so as to reduce to a minimum the command transmission time. This arrangement makes it possible to reduce the weight carried by the support. The units carried by the chassis are remotely controlled by a microprocessor-based unit over a remote control line.

10 Claims, 4 Drawing Figures

ELECTROSTATIC PAINTING APPARATUS

BACKGROUND OF THE INVENTION

1. Field of the invention

The invention relates to electrostatic painting apparatus comprising: a support which is movable at high speed through the intermediary of a least one drive member and which carries a pneumatic sprayer with a nozzle supplied with paint and pressurized gas through pneumatic valve means and means for electrostatically charging the sprayed jet, raised to a high voltage; a paint feed assembly controlled by air pressure and comprising a paint pressure regulator and a discharge valve; gas pressure regulating means for the sprayer and the pressure regulator, electrically controlled; electrically controlled pneumatic valves for controlling the discharge valve of the feed assembly and the valve means of the regulator; and programmed logic means adapted to define operating sequences.

2. Description of the prior art

Pneumatic sprayers are usually of two types designated round jet and flat jet. Round jet sprayers, utilized primarily for painting objects featuring openings, generally comprise a paint nozzle on the axis of a sprayer chamber into which open two pressurized gas distributors, the first of which is axial and causes the actual spraying and the second of which is tangential to generate a vortex.

Flat jet sprayers are designed primarily for painting large surfaces, such as automobile bodies, and also comprise a paint nozzle and an axial first pressurized gas distributor which surrounds the nozzle and a second pressurized gas distributor with oblique passages converging towards the axis of the sprayed jet, from either side thereof, so as to flatten the jet.

Note that for both types of sprayer the axial first pressurized gas distributor primarily conditions the fineness of the spray whereas the second, which is oblique relative to the axis of the nozzle, primarily conditions the shape of the sprayed jet (vortex aperture or flattening of the jet).

Nevertheless, there are interractions between the pressure at which the paint is delivered to the nozzle, the pressure of the gas supplied to the first distributor and that to the second distributor, to determine the discharge rate of paint from the sprayer and the shape of the jet, for adequate spraying quality. It will be understood that since the quality of spraying is a condition with which compliance is mandatory, there correspond to a pair of output parameters (paint discharge rate and jet shape) which relate to with the part which is to be painted, three input parameters: the pressure at which paint is admitted to the nozzle, the pressure of the gas supplied to the first distributor and the pressure of the gas supplied to the second distributor. Where relatively small quantities of parts are to be painted, these parameters are adjusted by an operator. For larger quantities correspondences are defined between the output and input parameters and recorded in the form of algorithms by means of which the input parameters may be obtained by entering the required output parameters.

French Pat. No. 1,537,997 describes a sprayer in which the three input parameters are modified by manipulating a single member which adjusts conjointly the fluid passage cross-sections.

As has already been implied, electrostatic painting aparatus for mass production lines must be able to work at the same rate as the line and be adaptable to the specific conditions for painting parts. In particular, it must be possible to adjust the sprayer in mid-cycle to modify the shape of the jet, the paint discharge rate and possibly the high voltage (in the case of hollow parts, for example). Also, it must be possible to shut off and restart the sprayer during each cycle, implying on/off valve means controlling the admission of fluids to the nozzle. All these operations may be controled according to predefined operating sequences by a microprocessor-based process control computer.

Incidentally, these operations form part of more extensive operating sequences, including for example adjustments concerning the travel of the support over a guide, displacement speed and change of direction point, in particular. In certain cases, displacements of the guide must be added to that of the support, in order to accompany a moving part or to dip into a cavity, for example. If the support is mounted on a multiple axis robot, an arrangement which is currently in widespread use, the operating sequence encompasses control of the robot relative to these various axes. Note that movements of the sprayer, in correspondence with the operating conditions, govern the adjustments specific to the sprayer: paint discharge rate, jet shape, high voltage.

Painting apparatus for mass production lines also incorporates color change sub-sequences which are commanded between the cycles for painting two consecutive parts. The color change processes, known per se, involve rinsing with a solvent to avoid one color being polluted by the preceding color.

The various aspects of automation of electrostatic painting apparatus for mass production lines have often been considered separately, the interface units between the painting apparatus and the controlling computer being progressively added or substituted for less effective units on older apparatus. It has been realized that the general organization of painting apparatus should take into account the response times of these interface units, these times including transmission times over the connecting lines.

These times are determined by the speed of movement of the support which carries the sprayer. On a reciprocating carriage the displacement speed is usually around one meter per second. In reciprocating movement, direction changes involving accelerations of 10 $ms^{-2}$ last 0.2 seconds. The sprayer adjustments must also be carried out in less than 0.2 seconds, representing a travel of 0.2 m. The time to output a digital control signal is expressed in microseconds; there is no problem from this point of view. Slaving the position of a fluid pressure adjusting member to an electrical control signal involves time constants on the order of one hundredth of a second, which is entirely acceptable. However, the transmission of a fluid pressure along a pipe is significantly slower, depending on the length and cross-section of the fluid passage.

With multiple axis robots, the tolerable adjustment times are at least as short as in the case of a reciprocating carriage.

In a similar manner, adjusting the high voltage applied to the members for electrostatically charging the jet involves a time constant which, broadly speaking, is defined by the impedance of the supply as seen by the charging members and the capacitance as seen by the supply. To give an idea of the orders of magnitude involved, to obtain in 0.1 seconds a voltage of 60 kilovolts with a supply producing 60 microamperes, the maximum capacitance is 100 picofarads. The self-capacitance of a shielded connecting cable rated at 60 kilovolts is routinely between 30 and 40 picofarads per meter.

If the support were made to carry all the electrically controlled adjuster devices and the pneumatically controlled actuator devices, in order to reduce the distance of these devices from the sprayer and the control time constants, the weight carried by the support would be incompatible with the accelerations which must be applied to it, unless the support, its guides and the drive means which actuate it were reinforced. Such reinforcing arrangements are inevitably costly and bulky, and are often of an illusory nature; when the weight of the active members becomes negligible in comparison with that of the accessory and supporting members, the gain resulting from such reinforcement is virtually all absorbed by the resulting increase in weight due to the reinforcement.

An object of the invention is a sprayer apparatus in which the weight carried by the mobile support is reduced to a minimum although the time to execute adjustments is compatible with carrying out the same while in operation.

SUMMARY OF THE INVENTION

In one aspect, the invention consists in an electrostatic painting apparatus comprising a drive member; a support which is adapted to be moved at high speed by the drive member; a sprayer which is carried by the support and which comprises a paint sprayer nozzle and two distributors adapted to be supplied with pressurized gas, a first of which is substantially coaxial with the apparatus and the second of which is oblique relative to the axis of the apparatus, and which are adapted to cooperate with one another to form a shaped paint jet, pneumatic valve means for the fluids supplied to the nozzle and means for electrostatically charging the sprayed jet; a paint feed assembly which is juxtaposed to the sprayer and which comprises a pneumatically controlled paint pressure regulator and a valve for discharging the pneumatically controlled regulator; an electrical supply for the charging means which comprises a controlled low-voltage supply and a high-voltage generator connected to the low-voltage supply and adapted to generate a high DC voltage; three electrically controlled gas pressure regulators, one for each of the distributors and one for the paint pressure regulator; two electrically controlled pneumatic on/off valves respectively connected to the pneumatic valve means and the discharge valve; programmable logic means adapted to distribute electrical control signals to the aforementioned electrically controlled means in sequences which correspond to predetermined operating sequences; a chassis which is disposed on the drive member at a position immediately adjacent a center position of the support and which carries the high-voltage generator, the gas pressure regulating means and the two electrically controlled pneumatic valves; and a harness adapted to connect the means disposed on the chassis to the means disposed on the support, the length of the harness being substantially equal to the minimum length necessary for movement of the support relative to the chassis.

The juxtaposing of the paint feed assembly on the sprayer on the mobile support authorizes automatic color changes in the time interval separating the passage of two consecutive parts through the painting station, especially when the dead volumes between the feed assembly and the sprayer are reduced to the minimum, which reduces the quantity of ringing solvent to be fed into the nozzle. This arrangement is routine for sprayers which are not moved at high speed. The arrangement of the feed assembly has been designed, however, so that the weight carried by the support (sprayer and feed assembly) does not exceed two kilograms, which is compatible with the displacement control systems previously used.

The grouping together of the units to be mounted on the chassis is a concrete solution to the problem previously outlined, with regard to the time to transmit pressure changes along pipes and the necessity for a compromise with regard to the reduction of the weight carried by the support. The number of control devices grouped together on the chassis has been limited to that strictly necessary so that the assembly is compact and does not entail any lengthening of the pipes between any of the aforementioned units and the connecting harness. This is particularly remarkable in the case of the high-voltage supply. This has been divided into two subassemblies, one containing all the control and safety circuits and having a relatively low AC output voltage at a low impedance and the other subassembly comprising only those units needed to generate the high DC voltage which is produced at a high impedance, this latter subsystem, which is adapted for compact implementation, being disposed on its own on the chassis. The various connecting lines all terminate at substantially the same locations and are thus of the same length so that they can be grouped together to form a harness. This enables the support to be moved over the full extent of its possible travel, while keeping the length of the connecting lines to the minimum.

The apparatus preferably further comprises a pneumatic actuator and the sprayer preferably comprises, in an assembly aligned with the pneumatic actuator, a first valve connected to the actuator and disposed on the inlet side of the second pressurized gas distributor, a second valve coupled to the actuator with a first clearance and disposed on the inlet side of the first distributor, and a needle valve coupled to the actuator with a second clearance and disposed on the inlet side of the sprayer, the first and second valves and the needle valve each comprising elastic means whereby the obturator is normally urged against the seat so as to close the valve and the first and second clearances being such that operation of the actuator lifts successively or simultaneously from their seats the obturators of the first and second valves and the needle valve. Thus the valves and the needle valve bear independently on their respective seats, and wear affecting any one of them does not compromise the seal at the others.

The gas pressure regulators associated with the pressurized gas distributors each preferably comprise an electrically controlled pressure modulator and a flowrate amplifier which is pneumatically controlled by the pressure modulator. The flowrate amplifier, which is known per se, comprises, on respective sides of a diaphragm, a first chamber exposed to the control pressure and a second chamber with a large needle valve and connected, on the inlet side of the needle valve, to a supply of pressurized gas. Displacement of the needle valve due to pressure differentials between these chambers ensures that the outlet pressure from the second chamber is substantially the same as that applied to the first chamber, even when the discharge rate into the second chamber is high.

A correlator device preferably controls the three gas pressure regulators and is adapted to output three control signals to the regulators in response to two input parameters processed by a predetermined algorithm.

In a preferred arrangement the feed assembly, juxaposed to the sprayer, comprises, machined into a common block of material, a regulator which has two chambers and a diaphragm separating the chambers, a control air line connected to a first of the chambers, a paint outlet passage leading from the second of the chambers to the sprayer, a discharge passage, a paint inlet passage and a needle valve in the paint inlet passage coupled to the diaphragm, whereby the needle valve obturator is raised from its seat when the pressure in the first chamber exceeds that in the second chamber, and the discharge valve comprises a chamber, a diaphragm closing the chamber, a control air inlet to the chamber, a needle valve adapted to shut off the discharge passage of the regulator and a spring adapted to urge the needle valve towards the closed position, in opposition to the pressure of the air acting on the diaphragm.

Other subjects and advantages will appear from the following description of an example of the invention, when considered in connection with the accompanying drawings, and the novel features will be particularly pointed out in the appended claims.

DESCRIPTION OF THE PREFERRED EMBODIMENT

Figure 1:
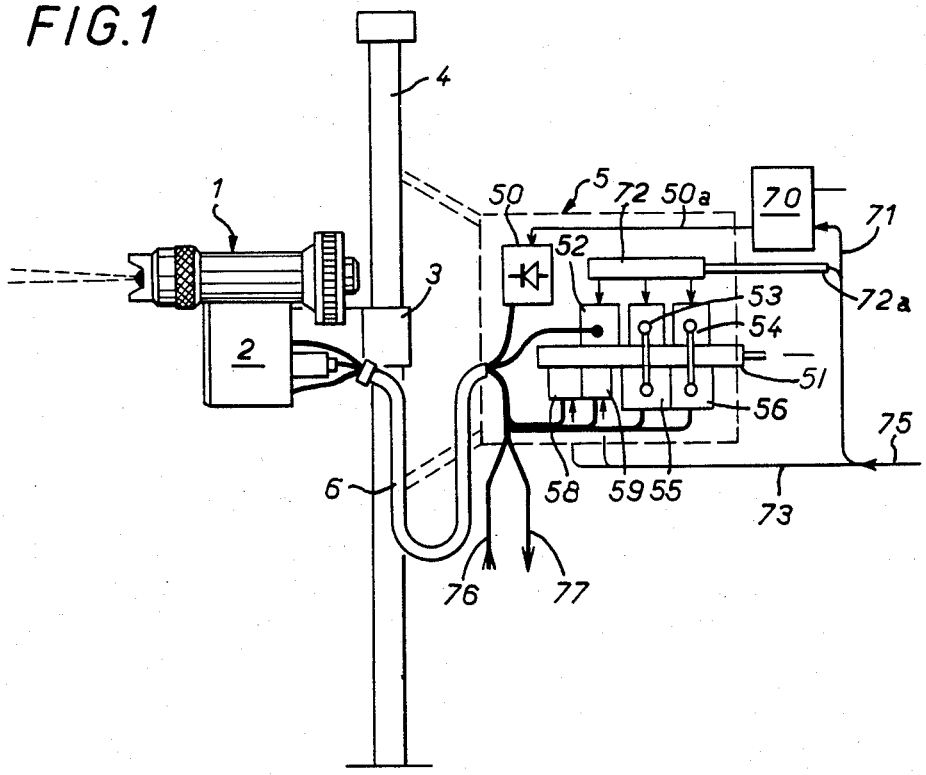
FIG. 1 is a schematic representation of apparatus in accordance with the invention.

Referring to FIG. 1, the apparatus comprises a pneumatic sprayer 1 resting on a feed assembly 2 and mounted on a support or carriage 3 which can move to and fro on a vertical slide 4 forming a guide when acted on by a drive assembly (not shown). The feed assembly 2 is connected to a chassis 5 by a flexible connecting harness 6. The chassis 5 is mounted at the level of a central part of the slide 4 in the immediate vicinity of the latter, and the length of the harness 6 is determined so that the support 3 can move over all of the slide 4 but so that at the two end positions of the support the harness 6 is almost stretched; in other words, the length of the harness 6 is the minimum length compatible with the maximal travel of the support 3.

As will emerge in more detail hereinafter, supplying the sprayer 1 involves a paint feed line, two compressed air lines adjusted for spraying and shaping the sprayed paint jet, a compressed air line for controlling the fluid valves of the sprayer and a high-voltage line for electrostatically charging the jet. As will be explained hereinafter, all these lines pass through the feed assembly 2 which itself comprises a paint pressure regulator which is pneumatically controlled and a regulator discharge valve, also pneumatically controlled. The paint feed line passes through the regulator. For operating the feed assembly there are a paint discharge line, a compressed air line adjusted to control the regulator and a compressed air line for controlling the discharge valve. Thus the harness 6 comprises a high-voltage feed cable, three compressed air lines, two for the sprayer jet and one for controlling the paint pressure regulator, two compressed air lines for controlling the sprayer valves and the discharge valve, and two paint lines, a feed line and return line.

Disposed on the chassis 5 are connection devices for the lines of the harness 6, except for the paint feed line 76 and paint return line 77 which are directly connected to a color changing system of known type.

Thus there is disposed on the chassis a high-voltage generator 50 consisting of only those items necessary to generate a high DC voltage from a low voltage supplied over a line 50*a*. The generator is typically a voltage multiplier comprising rectifier diodes and capacitors supplied with a voltage of not more than a few thousand volts at a frequency of a few hundred Hertz from an oscillator supplied at a few tens of volts. Mounted on a compressed air distribution manifold 51 are three electrically controlled gas pressure regulators 52, 53 and 54. These pressure regulators (or modulators), which are known devices, incorporate a control system using an analog electrical signal as the set point signal and, as an actuator member, a needle valve admitting air into a measuring chamber from the compressed air manifold 51, such that the pressure in this measuring chamber is proportional to the set point signal. The regulators 53 and 54 drive respective flowrate amplifiers 55 and 56 also mounted on the distribution manifold 51. These flowrate amplifiers, the construction of which will be described hereinafter, are known devices which deliver gas at a pressure substantially equal to a control pressure, over an extended range of flowrates.

The pressure regulators 52, 53 and 54 are controlled from a correlator device 72 which receives the input parameters over lines 72*a*. This correlator device, of which further mention will be made hereinafter, is a logic device which converts two input parameters into signals fed to the three pressure regulators so that spraying occurs as required, with a jet shape and paint discharge rate as required.

Two solenoid valves 58 and 59 are mounted on the manifold 51, for controlling the valve means of the sprayer and the discharge valve of the regulator, respectively.

Figure 2:
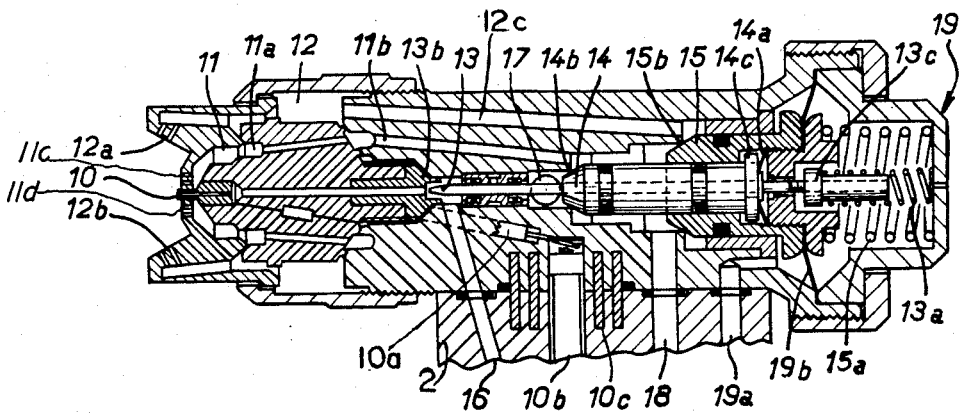
FIG. 2 shows in axial cross-section a sprayer adapted to be fitted to apparatus in accordance with the invention.

The sprayer, shown in FIG. 2, is in this instance a flat jet sprayer. It comprises a conductive paint nozzle 10 which is fed with paint by a paint line 16 shut off by an axial needle 13. The nozzle is also connected to a high-voltage terminal 10*b* through resistors 10*a* intended to prevent the formation of sparks. Note that the terminal 10*b* is surrounded by two concentric skirts 10*c* so as to break the surface leakage lines.

The nozzle 10 is centered in an annular chamber 11 supplied parallel to the axis from a first compressed air line 11*b* and an annular distributor 11*a*. The end of the nozzle 10 forms a point to favor ionization. The line 11*b* is fed by the line 17 through a valve 14.

On opposite sides of the axis of the jet produced by the nozzle 10 are disposed two ejectors 12*a* and 12*b* directed obliquely towards the axis of the nozzle 10, forward of the latter, and forming outlet orifices 11*c* and 11*d* from a distributor 12 fed by a line 12*c* connected to an input line 18 via a valve 15.

Behind the sprayer 1 is a pneumatic actuator 19 which comprises a diaphragm 19*b* delimiting a chamber supplied with compressed air via the line 19*a*. The valve 15 is attached to the center of the diaphragm 19*b* and is held against its seat 15*b* by a spring 15*a*.

The valve 14 is mounted slidably in the valve 15 and has at its rear end a shoulder 14*c*. A cup spring 14*a* bearing on the bottom of a cavity formed in the valve 15 to permit displacement of the shoulder 14*c* urges the valve 14 against its seat 14*b*. The needle 13 passes axially through the valve 14 and is anchored in a shouldered plunger 13*c*; a spring 13*a* is inserted between the back of the actuator 19 and the plunger 13*c*, so as to urge the needle 13 against its seat 13*b*. It will be understood that admitting compressed air through the line 19*a* pushes the diaphragm 19*b* towards the rear of the sprayer 1 and entrains the valve 15 which is lifted from its seat 15*b*, establishing communication between the line 18 and the distributor 12 with oblique ejectors 12*a*, 12*b*. In moving back, the valve 15 entrains the valve 14 by its shoulder 14*c*, which establishes communication between the line 17 and the distributor 11*a* which feeds the chamber 11 axially. As it continues to move back the valve 15 comes into contact with the plunger 13*c* which causes the needle 13 to lift off its seat 13*b*. The paint under pressure in the line 16 reaches the nozzle 10. Note that the clearance between the valve 15 and the shoulder 14*c* of the valve 14 is small and is primarily intended to permit the valve 14 to bear on its seat 14*b* when acted on by the cut spring 14*a* independently of the bearing of the valve 15 on its seat 15*b*. On the other hand, the clearance between the valve 15 and the plunger 13*c* is significantly greater so that not only is the bearing of the needle 13 on its seat 13*b* independent of the bearing engagements of the valves, but also the needle 13 does not lift off its seat 13*b* until after the flow from the distributors 11*a* and 12 is established. As a subsidiary feature, these clearances represent the differential wear tolerances within which operation of the valves remains correct.

Figure 3:
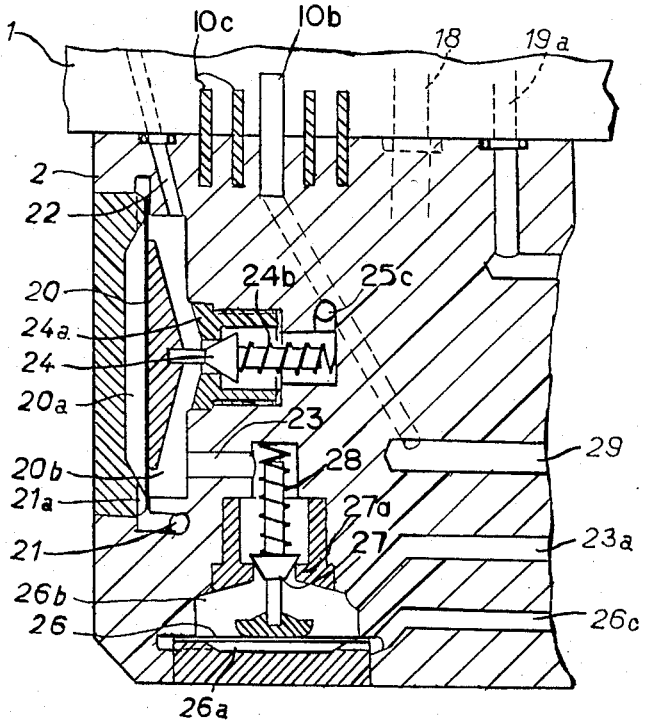
FIG. 3 shows in cross-section part of the feed assembly to be juxtaposed to the sprayer of FIG. 2.

The feed assembly 2 shown in FIG. 3 is juxtaposed to the sprayer 1 in such a way that the high-voltage contact 10*b* plugs into a complementary socket electrically connected to a high-tension cable input 29. The fluid inlets to the sprayer 16, 17, 18, 19*a* communicate, with appropriate seals, with the corresponding channels in the feed assembly 2. In the case of the lines 17, 18, 19*a* the passages in the assembly 2 make direct connection to the connectors for the flexible lines of the harness 6.

The assembly 2, which is constructed from an insulative material, is hollow out to accommodate a paint pressure regulator. This regulator comprises a flexible diaphragm 20 disposed between two chambers 20*a* and 20*b*. The chamber 20*a* communicates with a control air line 21 through passages 21*a*. The chamber 20*b* in which the paint circulates is provided with an outlet passage 22 to the sprayer line 16, a discharge passage 23 and a valve 24 urged against its seat 24*a* by a spring 24*b* and bearing on the diaphragm 20. At the rear of the valve 24 is a line 25 which receives the pressurized paint.

The discharge passage 23 is shut off by the obturator 27 of a discharge valve, this obturator 27 being urged onto a seat 27*a*, in the direction from the passage 23 towards the obturator 27, by a spring 28. The discharge valve comprises a diaphragm 26 between a control chamber 26*a* with which a control air line 26*c* opens and a discharge chamber 26*b* into which the obturator 27 communicates and from which the return line 23*a* extends. The diaphragm 26, lifted by the air pressure in the chamber 26*a*, pushes the obturator 27 off its seat 27*a* and establishes communication between the passage 23 and the return line 23*a*.

Although the feed assembly is sell known in its broader aspects, since electrostatic painting apparatus featuring quick color change utilizes functionally identical devices, it should be remembered that the pressure of the paint in the chamber 20*b* is substantially equal to the pressure of the air in the control chamber 20*a*, entry via the valve 24 being regulated by the pressure differential across the diaphragm 20, so as to balance the flowrate through the line 22 at the regulated pressure.

To effect a change of color the paint of the first color is passed through with a cleaning solvent, with intervening air blasts, with the sprayer actuator in the closed position and the discharge valve 26, 27 open so that excess paint and the rinsing solvent escape through the line 23*a*. The discharge valve is then briefly closed with the sprayer open so that a small quantity of solvent is ejected, removing any paint remaining in the sprayer and rinsing the latter. It goes without saying that this color change operation must be carried out in the time interval between two consecutive parts. The user may be recommended to locate the sprayer in an extreme end of travel position, facing a receptacle, to prevent traces of paint being projected into the spraying booth.

After rinsing the sprayer, the new paint is admitted and the operating cycle resumes.

Figure 4:
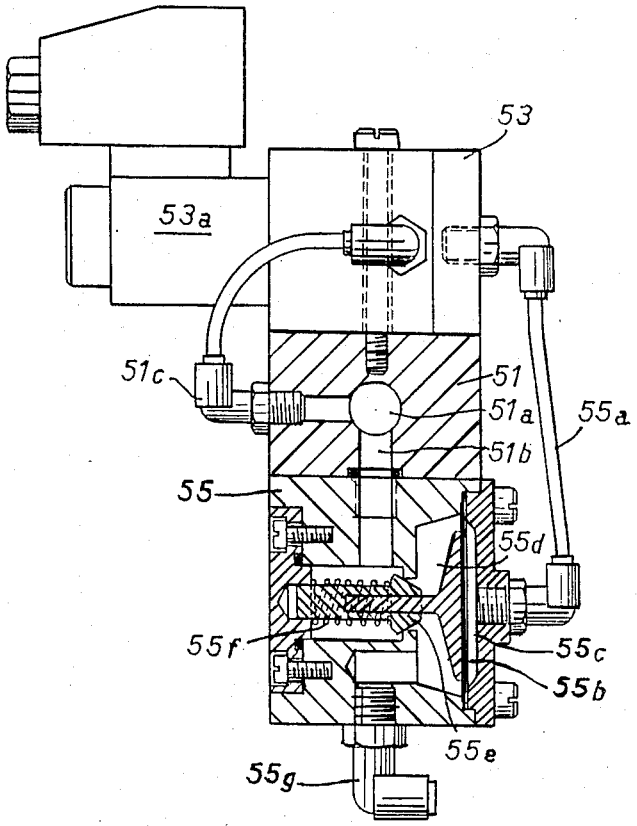
FIG. 4 is a cross-section through a gas flow-rate amplifier.

The air pressure regulators shown in FIG. 4 comprise a pressure modulator 53 with a slaved proportional valve coil 53*a* fed from the manifold 51 through the line 51*c* and applying to the line 55*a* a pressure proportional to an electrical voltage applied to the proportional valve 53*a*. The pressure modulator 53 controls the flowrate amplifier 55 which comprises a diaphragm 55*b* between a control chamber 55*c* into which the line 55*a* opens and a slave chamber 55*d*. This is connected to an inlet passage connected to an outlet 51*b* of the manifold 51 through a valve 55*e* the obturator of which is urged against its seat and against the diaphragm 55*b* by a spring 55*f*. The slave chamber has an outlet passage 55*g* for connection to the device output.

Note that the flowrate amplifier is analogous to the paint pressure regulator. However, note also that the needle 55*e* is of significantly greater diameter than the needle of the regulator, so as to limit head losses at high flowrates.

After describing in detail the individual functioning of the component parts of the apparatus, reference will again be made to FIG. 1 to describe their conjoint operation. The computer-generated control sequences are addressed to units situated on the chassis 5 over the conductors 75 which comprise a high-voltage control conductor 71, a sprayer fluid adjustment conductor 72*a* and a solenoid valve control conductor 73. The conductor 71 carries digital signals indicative of the high voltage. The supply 70 comprises a digital-to-analogue converter and a generator producing a DC voltage of a few tens of volts. The output voltage of this generator is slaved to the analogue signal from the converter. The voltage applied over the line 50*a* to the generator 50 generates a high DC voltage for elecrostatically charging the jet, through the intermediary of an oscillator running at several hundred Hertz and a rectifier/voltage multiplier.

The signals addressed to the correlator 72 over the line 72*a* are digital and represent a paint discharge rate, a spray particle size and a jet flattening factor. The correlator converts these signals into paint pressure set points for the regulator 52 and air pressure set points for the axial distributor and the oblique distributor for, respectively the regulators 53 and 54. The pressure set points are converted to actual pressure, from the regulator 52 by the feed assembly regulator (FIG. 3) and from the regulator 53 and 54 by the flowrate amplifiers. The sprayer is ready to be operated. Conjointly with this, signals addressed to the drive equipment for the support 3 has indicated the displacement speed and the change of direction points. When a part reaches the coverage area of the sprayer the solenoid valve 58 is opened so as to operate the actuator 19 of the sprayer 1. The painting cycle begins, and during it the various adjustments in respect of the fluid pressures, the high voltage and the support displacement speed may be varied. The painting cycle is terminated by de-energizing the solenoid valve 58. The sequence corresponding to a color change has already been discussed. During this the solenoid valve 59 commands the discharge valve of the feed assembly 2 to open so as to discharge excess paint and rinsing solvents.

MODIFICATIONS

It will have been understood that the chassis 5 is attached to the slide 4 so that the harness 6 authorizes movement of the support 3 over this slide. However, the combination of the chassis 5 and the slide 4 may be rendered movable at moderate speed if the operating sequence requires this, in order to accompany the part to be painted as it moves or to reach certain portions of the parts, for example. Note that the reduction in the weight of the units carried by the support 3 is at least as necessary when the slide 4 is mobile as when it is fixed since, as follows from what has been explained hereinabove, increasing the load on the support 3 results in an increase in the weight of the slide 4 and the driving means which displace the support on the slide; the devices which displace the frame which carries the slide, complementing the displacements of the support on the slide, must be adapted to the load to be displaced.

There has been described apparatus equipped with a flat jet sprayer. It goes without saying that the apparatus could be equipped with a vortex type round jet sprayer, in particular by merely replacing the nozzle. In any event, a round jet sprayer comprises the same feed arrangements as a flat jet sprayer, namely a paint feed assembly, respective pressurized gas supplies for an axial distributor and an oblique distributor, a high-voltage supply and an actuator control system for the valves for the fluids supplied to the nozzle. By virtue of the flexibility of the various adjustments, changing the sprayer type does not entail any modification of the layout of the various units constituting the apparatus in accordance with the invention.

It will be clear that the apparatus as described could be applied to a multiple axis robot having a multiple pivot arm and capable of offering up the sprayer in a continuous sequence of positions relative to the surfaces to be painted. The chassis would then be attached to one of the last segments of the arm, in the immediate vicinity of the end to which the sprayer support is attached.

It is emphasized that the units which are mounted on the chassis are all known per se so that their replacement with functionally equivalent members would in no way depart from the scope of the invention.

Finally, it goes without saying that if the sprayer mounted on the support did not involve electrostatically charging the sprayed jet of paint, the chassis would not carry any high DC voltage generator, without the functional arrangements specific to the invention being consequently modified. Further, apparatus incorporating a pneumatic sprayer with no charging of the jet would remain within the scope of the invention.

More generally, it will be understood that various changes in the details, materials and arrangements of parts which have been herein described and illustrated in order to explain the nature of the invention may be made by those skilled in the art with the principle and scope of the invention as expressed in the appended claims.

We claim:

1. Electrostatic painting apparatus comprising:

(a) drive means;

(b) a support mounted for movement at high speed by said drive means, said support carrying (i) a sprayer having a predetermined longitudinal axis, said sprayer comprising a paint sprayer nozzle and two distributors adapted to be supplied with pressurized gas, a first distributor being arranged to supply said gas substantially coaxially with the predetermined longitudinal axis of said sprayer and the second distributor being arranged to supply said gas obliquely relative to the predetermined axis of said sprayer, said two distributors being cooperating with one another to form a shaped paint jet, said sprayer further comprising pneumatic valve means for controlling the fluids supplied to said nozzle and means for electrostatically charging the sprayed jet;

(ii) a paint feed assembly which is mounted on said sprayer and which comprises a pneumatically controlled paint pressure regulator and a valve for discharging said pneumatically controlled pressure regulator;

(c) an electrical supply for said means for electrostatically charging which comprises a controlled low-voltage supply and a high-voltage generator connected to said low-voltage supply and adapted to generate a high DC voltage;

(d) three electrically controlled gas pressure regulators, one for each of said two distributors and one for said paint pressure regulator;

(e) two electrically controlled pneumatic on/off valves respectively connected to said pneumatic valve means and said discharge valve;

(f) programmable logic means adapted to distribute electrical control signals to said three electrically controlled gas pressure regulators and said two electrically controlled pneumatic on/off valves in sequences which correspond to predetermined operating sequences;

(g) a chassis fixedly disposed on said drive means at a position immediately adjacent to a center of the extent of travel of said support on said drive means, said chassis carrying a plurality of members including said high-voltage generator, said three electrically controlled gas regulators and said two electrically controlled pneumatic on/off valves; and (h) a harness selectively connecting said plurality of members disposed on said chassis to said sprayer and said paint feed assembly mounted on said support, said harness having a length which is substantially equal to the minimum length necessary for movement of said support relative to said chassis for a given horizontal spacing between said chassis and said support.

2. Apparatus according to claim 1, wherein said sprayer comprises a vortex round jet type sprayer and wherein said two distributors communicate with an annular chamber coaxial with said sprayer, the first distributor being coaxial relative to said chamber and the second distributor being tangential relative to said chamber.

3. Apparatus according to claim 1, comprising a flat jet sprayer and wherein said first distributor consists of a nozzle coaxial with said sprayer and said second distributor consists of two ejectors symmetrical relative to the jet axis and convergent towards said jet axis at the base of the jet.

4. Apparatus according to claim 1, further comprising a pneumatic actuator and wherein said sprayer comprises, in an assembly aligned with said pneumatic actuator, a first valve connected to said actuator and disposed on an inlet side of said second pressurized gas distributor, a second valve coupled to said actuator with a first clearance and disposed on an inlet side of said first distributor, and a needle valve coupled to said actuator with a second clearance and disposed on an inlet side of said sprayer, said first and second valves and said needles valve each having a valve seat and an obturator and each of said valves comprising elastic means whereby the obturator is normally urged against the valve seat so as to close the valve, and said first and second clearances being such that operation of said actuator lifts the obturators of said first and second valves and said needle valve from the respective valve seats.

5. Apparatus according to claim 4, wherein said actuator successively lifts the obturators of said first and second valves and said needle valve from their respective valve seats.

6. Apparatus according to claim 4, wherein said actuator simultaneously lifts the obturators of said first and second valves and said needle valve from their respective valve seats.

7. Apparatus according to claim 1, wherein said electrically controlled gas pressure regulators associated with said pressurized gas distributors each comprise an electrically controlled pressure modulator and a flow-rate amplifier which is pneumatically controlled by said electrically controlled pressure modulator.

8. Apparatus according to claim 1, further comprising a correlator device which controls said electrically controlled three gas pressure regulators and which is adapted to output three control signals to said gas pressure regulators regulators in response to two input parameters processed by a predetermined algorithm.

9. Apparatus according to claim 1, wherein said feed assembly comprises, machined into a common block of material, said pneumatically controlled paint pressure regulator which has two regulator chambers and a first diaphragm separating said regulator chambers, a control air line connected to a first of said regulator chambers, a paint outlet passage leading from the second of said regulator chambers to said sprayer, a discharge passage, a paint inlet passage and a first needle valve obturator in said paint inlet passage coupled to said first diaphragm, whereby said first needle valve obturator is raised from its seat when the pressure in said first regulator chamber exceeds that in said second regulator chamber and wherein said discharge valve comprises a discharge chamber, a second diaphragm closing said discharge chamber, a control air inlet to said discharge chamber, a second needle valve obturator adapted to shut off said discharge passage of said pneumatically controlled paint pressure regulator and a spring adapted to urge said second needle valve obturator towards the closed position, in opposition to the pressure of the air acting on said diaphragm.

10. Painting apparatus comprising:

(a) a drive means;

(b) a support which is mounted for movement at high speed by said drive means;

(c) a sprayer which is carried by said support, said sprayer having a longitudinal axis and comprising a paint sprayer nozzle, two distributors adapted to be supplied with pressurized gas, a first distributor being substantially coaxial with said longitudinal axis of the sprayer and a second distributor being oblique relative to said axis of the sprayer, and said two distributors cooperating with one another to form a shaped paint jet and said sprayer further comprising pneumatic valve means for controlling the fluids supplied to said paint sprayer nozzle;

(d) a paint feed assembly which is mounted on said sprayer and which comprises a pneumatically controlled paint pressure regulator and a valve for discharging said pneumatically controlled regulator;

(e) three electrically controlled gas pressure regulators, one for each of said two distributors and one for said paint pressure regulator;

(f) two electrically controlled pneumatic on/off valves respectively connected to said pneumatic valve means and said discharge valve;

(g) programmable logic means adapted to distribute electrical control signals to said electrically controlled gas pressure regulators and said two electrically controlled pneumatic on/off valves in sequences which correspond to predetermined operating sequences;

(h) a chassis which is fixedly disposed on said drive means at a position immediately adjacent a center of the extent of travel of said support on said drive means and which carries said three gas pressure regulators and said two electrically controlled pneumatic valves; and (i) a harness connecting the three gas pressure regulators and the two electrically controlled pneumatic valves disposed on said chassis to the sprayer and the feed assembly disposed on said support, said harness having a length which is substantially equal to the minimum length necessary for movement of said support relative to said chassis for a given horizontal spacing between said chassis and said support.

* * * * *